US008628304B2

(12) United States Patent
Becker et al.

(10) Patent No.: US 8,628,304 B2
(45) Date of Patent: Jan. 14, 2014

(54) MULTI-STAGE MEMBRANE SUCTION PUMP

(75) Inventors: Erich Becker, Bad Krozingen (DE); Erwin Hauser, Emmendingen (DE)

(73) Assignee: KNF Neuberger GmbH, Freiburg (DE)

( * ) Notice: Subject to any disclaimer, the term of this patent is extended or adjusted under 35 U.S.C. 154(b) by 581 days.

(21) Appl. No.: 12/744,576

(22) PCT Filed: Nov. 11, 2008

(86) PCT No.: PCT/EP2008/009493
§ 371 (c)(1),
(2), (4) Date: May 25, 2010

(87) PCT Pub. No.: WO2009/068180
PCT Pub. Date: Jun. 4, 2009

(65) Prior Publication Data

US 2010/0263750 A1 Oct. 21, 2010

(30) Foreign Application Priority Data

Dec. 1, 2007 (DE) ..... 10 2007 057 945

(51) Int. Cl.
*F04B 23/04* (2006.01)

(52) U.S. Cl.
USPC ..... 417/62

(58) Field of Classification Search
USPC ..... 417/62
See application file for complete search history.

(56) References Cited

U.S. PATENT DOCUMENTS

| | | | | |
|---|---|---|---|---|
| 2,246,932 | A | 6/1941 | Collins | |
| 5,135,361 | A * | 8/1992 | Dion | 417/62 |
| 5,577,390 | A * | 11/1996 | Kaido et al. | 62/228.5 |

FOREIGN PATENT DOCUMENTS

| | | |
|---|---|---|
| DE | 20202190 | 7/2002 |
| DE | 102006043159 | 11/2007 |
| WO | 2004088138 | 10/2004 |

* cited by examiner

*Primary Examiner* — Charles Freay
(74) *Attorney, Agent, or Firm* — Volpe and Koenig, P.C.

(57) ABSTRACT

A multi-stage membrane suction pump having at least two pump chambers, each having a fluid inlet and a fluid outlet, and having a suction line connecting the fluid inlets. Successive pump chambers are connected via at least one connecting line such that the membrane pump upon reaching/exceeding a differential pressure in the suction line changes from a parallel operation into at least also a serial operation. In the inflow and outflow regions of the at least one connecting line, at least one check valve each is interposed, opening toward the subsequent pump stage. The check valves provided in the connecting line(s) are designed smaller compared to inlet and outlet valves of the pump chambers, and line sections of the connecting lines that open toward the neighboring pump chamber have a smaller clear line cross-section compared to the inlet and outlet valves, and are associated with the check valves.

9 Claims, 4 Drawing Sheets

MULTI-STAGE MEMBRANE SUCTION PUMP

BACKGROUND

The invention relates to a multi-stage membrane suction pump having at least two pump chambers, each comprising one fluid inlet, provided with at least one inlet valve, and one fluid outlet, comprising at least one outlet valve, as well as one suction line connecting the fluid inlets of the pump chambers, with successive pump chambers each being connected to one another via at least one connection line such that the membrane pump, upon reaching/exceeding a differential pressure in the suction line, changing from a parallel operation of its pump chambers to at least also a serial operation of said pump chambers, with a check valve being interposed in the inlet and the outlet area of at least one connecting line, open towards the downstream pump stage, and with the check valves provided in the inlet area and in the outlet area of the connection line(s) being embodied smaller in reference to the inlet valves and the outlet valves of the pump chambers.

During evacuation, for example of an autoclave, on the one hand a great flow rate is desired and on the other hand a good final vacuum. The great flow rate is achieved by switching the heads to a parallel configuration, the good final vacuum by a multi-stage operation, i.e. by way of switching it to a serial configuration. In many applications, primarily in lab operations, a low final pressure is required, which can only be achieved by a multi-stage arrangement.

From WO 2004/088138 a micro-vacuum pump is already known comprising two pump chambers, each limited by an oscillating pump membrane. Each of these pump chambers has a fluid inlet, comprising an inlet valve, and a fluid outlet, comprising an outlet valve, with a suction line connecting the fluid inlets of the pump chambers and a pressure line connecting the fluid outlets being provided. The pump chambers are connected to each other via a connection line such that the micro-vacuum pump of the prior art, upon reaching and exceeding a predetermined differential pressure in the suction line, changes from a parallel operation of its pump chambers into a serial operation of said pump chambers. One check valve each is interposed, open to the pump stage downstream, both in the inlet area as well as in the outlet area of the connection line. In order to reduce the expenses connected to the production of the membrane suction pump of prior art the check valves interposed in the connection lines show a size similar to the inlet valves and outlet valves of the two pump chambers. Accordingly, the line section of the connection line provided between one of the check valves, on the one side, and the adjacent pump chamber, on the other side, is sized comparatively large. In order to allow in the starting phase of a pumping process to first guide the fluid flow via the inlet valves and outlet valves switched parallel the connection line is provided with an interposed throttle, which only loses its throttling effect when reaching a respective differential pressure and a reduced pump capacity.

At the beginning of the suction process the micro-vacuum pump of the prior art assumes a parallel operating configuration of its pump chambers, because the throttle provided in the connection line causes that the system, due to the still missing strain in the air circulation, can initially function easier in parallel operation. As soon as this parallel operating configuration reaches the range of the final vacuum and the differential pressure in the suction line thus reaches its maximum the fluid can flow much easier through the throttle located in the connection line so that simultaneously also a serial operation of its pump chambers is being configured in order to yield a final vacuum as high as possible.

However, it is disadvantageous that the check valves of the membrane pump of prior art show a size similar to that of the inlet valves and the outlet valves, and that the line sections of the connection line provided between the check valves have a line cross-section of a size according to the connection line such that in these line sections a correspondingly large, dead space develops, which has unfavorable effects upon the achievable final vacuum of the above-mentioned membrane suction pump and negatively influences the switchover point from parallel to serial operation.

A superheated steam vacuum pump having at least two stages is known from DE 10 2006 043 159 B3, comprising membranes operating in a push-pull mode as the pump organs. The inlets and the outlets of the pump chambers of this multi-stage superheated steam vacuum pump are connected to each other in a parallel fashion via pipelines. Furthermore, a control line is provided, connecting the pump chambers, comprising a check valve arrangement having one control valve each arranged at the beginning and the end of the control line. At the beginning of each pumping process, i.e. with only little differential pressure between the pump inlet and the pump outlet, the two stages of the pump operate parallel because the control line is blocked by the vacuum-control valves. Beginning at a certain differential pressure the vacuum control valves open and the two pumps essentially operate serially. In order to create a greater differential pressure between the pump inlet and the pump outlet, the valve organs of the control valves provided in the control line show a weight that is at least 30% lower than the valve organs of the check valves provided in the pump inlet and in the pump outlet.

A valve-controlled operation control for multi-stage gas conveyer pumps is already known from DE 202 02 190 U1. In the operation control of prior art, which comprises a combination of two check valves as well as one pressure relief valve and/or a membrane-controlled vacuum valve, in which an automatic switching of the type of operation is achieved such that, upon reaching a defined pressure and/or vacuum, the pressure relief valve and/or membrane-controlled vacuum valve open, the check valves close, and the flow is conveyed from the pressure side of one pump stage to the suction side of another pump stage. This way, the pump stages are switched from a parallel operation to a serial one.

In DE 10 2006 043 B3 and DE 202 02 190 U1 improved solution are described in detail only for a preferably two-stage superheated steam vacuum pump and/or a valve-controlled mode of operation.

SUMMARY

Therefore, the object to be attained is the provision of a multi-stage membrane suction pump of the type mentioned at the outset allowing the creation of a final vacuum as high as possible within the shortest time possible, compared to prior art.

This is attained according to the invention particularly such that the check valves provided in the inlet area and the outlet area of the connection line(s) are each allocated to a line section of the connection line, open towards the adjacent pump chamber, having a smaller clear cross-section of the line in reference to the inlet and the outlet valves, and that at least one inlet valve, one outlet valve, and two check valves open in each of the pump stages remaining between the first pump stage and the last pump stage of the membrane suction pump.

The membrane pump according to the invention comprises at least one intermediate pump stage between the first and the last pump stage, and is embodied in at least three stages. While in the superheated steam vacuum pump of prior art, known from DE 10 2006 043 159 B3, a vacuum control valve is only provided at the beginning and the end of the control line, in the membrane suction pump according to the invention one check valve each is provided in each connection line between the pump stages at the inlet side and the outlet side. In order to additionally reduce any dead space it is provided according to the invention that at least one inlet valve, one outlet valve, and two check valves open in the pump stages remaining between the first and the last pump stage of the membrane suction pump.

The membrane pump according to the invention comprises check valves both at the inlet as well as outlet side of at least one connection line connecting the pump chambers, which are sized considerably smaller than the inlet valves and the outlet valves of said pump chambers. Due to the fact that the movable valve body of these check valves therefore show lesser moving masses as well and can react accordingly faster an approximation to the optimal switchover point from parallel to serial operation is considerably facilitated. Due to the fact that the connection line only becomes effective during operation at the optimal switchover point, and here the connection lines only need to handle relatively low flow rates in this pump phase, the clear cross-section of the connection lines can be embodied relatively small compared to the suction and pressure lines. This also allows embodying the check valves provided in at least one connection line with a very small passage cross-section and thus an appropriately small diameter compared to the suction and pressure valves. This way, due to the low weight of their movable valve or retaining element, the check valves can react quickly, during the closing process of the suction and pressure valves and prevent therefore that the membrane pump according to the invention fails to convey or insufficiently conveys in a transitional range of the differential pressure. Due to the fact that the check valves are each allocated to a line section leading to the adjacent pump chamber having a clear line cross-section considerably smaller than the inlet and outlet valves, the dead space remaining between the check valve, on the one side, and the adjacent pump chamber, on the other side, can be kept so small that even the creation of a very low final vacuum is possible. The membrane pump according to the invention therefore allows with comparatively simple technical means the creation of a final vacuum as low as possible in the shortest possible time.

Here, an embodiment is preferred in which one line section of the connection channel is each allocated to check valves connected to the adjacent pump chamber, which is sized such that, in reference to the inlet valves and the outlet valves, these line sections form an dead space smaller in reference thereto.

It is particularly advantageous when the check valves are sized and/or designed such that in the starting phase of the pumping process the inlet valves and the outlet valves are operational and the check valves are activated in a subsequent phase of the pumping process, preferably approximately at the optimal switchover point.

In order to keep the flow loss at high flow rates as low as possible in the suction line and the pressure line it is advantageous for the suction line and/or the pressure line to show a clear line cross-section larger than at least one connection line.

Due to the lower flow rate passing through the connection line it is advantageous for reasons of space to embody it with a smaller line cross-section as well.

Here, it is also possible that the outlet valves are perhaps embodied open towards the atmosphere, if applicable with a muffler being interposed. In such an embodiment any pressure line connecting the outlet valves is omitted.

In order to optimize the reaction time of the check valves provided in the connection lines it is advantageous when the check valves each comprise a valve disk as a valve body or retaining element, and when the pressure range of the differential pressure triggering the change to serial operation can be predetermined or set by selecting the diameter of the disk and/or by adjusting the weight of the valve disks.

In order for differential pressures as high as possible to develop, necessary for switching the valves, it is beneficial for the membranes allocated to the subsequent pump stages to be clocked off-set in reference to each other with regard to their suction and exhaust motions.

Here, a preferred embodiment according to the invention provides that the membranes allocated to the subsequent pump stages are clocked off-set by 180° in reference to their suction and exhaust motions.

The adverse space between the pump stages can be further reduced when two check valves are interposed in each connection line, with one of them being arranged upstream and the other one downstream.

The membrane pump according to the invention may be embodied in three stages or in any other multi-stage form. Here, it is advantageous when at least one inlet valve, one outlet valve, and one check valve each mouth in the first and the last pump stage.

BRIEF DESCRIPTION OF THE DRAWINGS

Additional embodiments according to the invention are discernible from the claims as well as the drawing. In the following the invention is described in greater detail using the preferred exemplary embodiments.

Shown are.

DETAILED DESCRIPTION OF THE PREFERRED EMBODIMENTS

Figure 1:
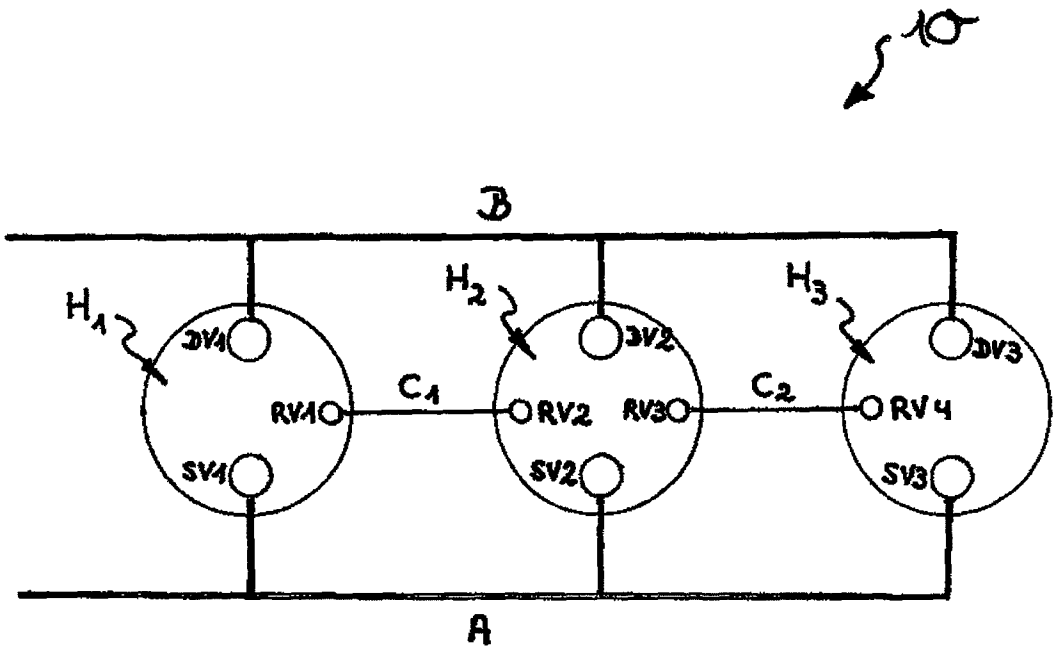
FIG. 1: a schematically shown configuration of a multi-stage membrane suction pump, comprising several pump chambers, which can be switched from an initially parallel operation, practically in an automated fashion, to a serial operation.

FIG. 1 shows a multi-stage membrane suction pump 10. The membrane suction pump 10 has at least two, here particularly three pump chambers $H_1$, $H_2$ and $H_3$. The pump chambers $H_1$, $H_2$ and $H_3$ each have one fluid inlet, comprising at least one inlet valve SV1, SV2, and/or SV3, and one fluid outlet, at least comprising an outlet valve DV1, DV2, and/or DV3. The membrane suction pump 10 has a suction line A, connecting the fluid inlets of the pump chambers $H_1$, $H_2$ and $H_3$ and a pressure line B connecting the fluid outlets. Here, successively arranged pump chambers $H_1$, $H_2$ and $H_3$ are each connected via at least one connection line C1 and/or C2 such that the membrane suction pump 1, upon reaching and particularly exceeding a pressure difference in the suction line A, changes from a parallel operation of its pump chambers $H_1$, $H_2$ and $H_3$ into a serial operation of said pump chambers $H_1$, $H_2$ and $H_3$.

FIG. 1 indicates that the connection lines C1 and C2, connecting the successive pump chambers to each other, show a smaller clear cross-section of the line compared to the suction line A and the pressure line B. Additionally, it is clearly discernible from FIG. 1 that at least one check valves is interposed in at least one connection line C1, C2, opening towards the downstream arranged pump stage $H_1$, $H_2$ and $H_3$. In the pump embodiment shown in FIG. 1 two check valves RV1, RV2 and/or RV3, RV4 are each interposed in each connection line C1 and C2, with one of them being arranged at the inlet side and the other one at the outlet side. The membrane suction pump 10 shown in FIG. 1 comprises at least one check valve RV1, RV2 and/or RV3, RV4 in at least one connection line C1, C2 connecting subsequent pump stages $H_1$, $H_2$ and $H_3$ with each other. This way, any dead space is limited in any case to the partial section of the connection line C1 and/or C2 remaining up to the check valve. Due to the fact that at least one check valve RV1, RV2 and/or RV3, RV4 allows the omission of any throttle in the connection line C1 and/or C2, the development of condensation, reducing the performance in an undesired fashion, is counteracted when conveying moist vapors. Due to the fact that the connection lines C1 and C2 are only effective in the range of the final vacuum and due to the fact that the connection lines C1 and C2 in this pumping phase only need to manage relatively low flow rates, the clear cross-section of said connection lines C1 and C2 can be embodied relatively small in reference to the suction line A and the pressure line B. This also allows the embodying of the check valves RV1, RV2, and/or RV3, RV4 provided in the connection line C1 and/or C2 with a very small passing cross-section in reference to the suction valves SV1, SV2, SV3, and pressure valves DV1, DV2, DV3, and an appropriately small diameter. This also allows for at least one check valve, due to the low weight of its movable valve body or retaining element to react quickly when the suction and pressure valves are closed and thus prevents that the membrane pump 1 fails to convey or insufficiently conveys in a transfer range of the pressure differences. The membrane pump 10 allows therefore with relatively simple technical means the creation of a final vacuum as high as possible in the shortest possible time.

In the connection lines C1 and C2, connecting the pump chambers $H_1$, $H_2$ and $H_3$ with each other, the membrane pump 10 comprises both at the inlet as well as the outlet side check valves RV1, RV2 and/or RV3, RV4, which are considerably smaller in size compared to the inlet and outlet valves SV1, SV2, SV3, and DV1, DV2, DV3 of these pump chambers. Due to the fact that the movable valve body of said check valves RV1, RV2, RV3, and RV4 therefore has a lower movable weight as well, and accordingly can react quicker, any approximation to the optimum switchover point from a parallel to a serial operation is considerably facilitated. Additionally, one line section each is allocated to the check valves, leading to the adjacent pump chamber $H_1$, $H_2$ and/or $H_3$, which compared to the inlet and outlet valves show a considerably smaller clear diameter of the line. This way, any dead space remaining between the pump chambers $H_1$, $H_2$ and $H_3$ and one of the check valves RV1, RV2, RV3 and/or RV4 can be kept so small that the creation of a relatively low final vacuum is also possible.

When switched parallel, the heads jointly suction via the line A and jointly eject via the line B. When reaching the final vacuum range of a one-stage compression, differential pressures develop between B-DV1, B-DV2, A-SV2, A-SV3. This results in the valves DV1, DV2, SV2, and SV3 to act as check valves, closing the flow. This way the heads are switched serially. The gas flow now occurs via: A-SV1-RV1-C1-RV2-RV3-C2-RV4-DV3-B.

Figure 2:
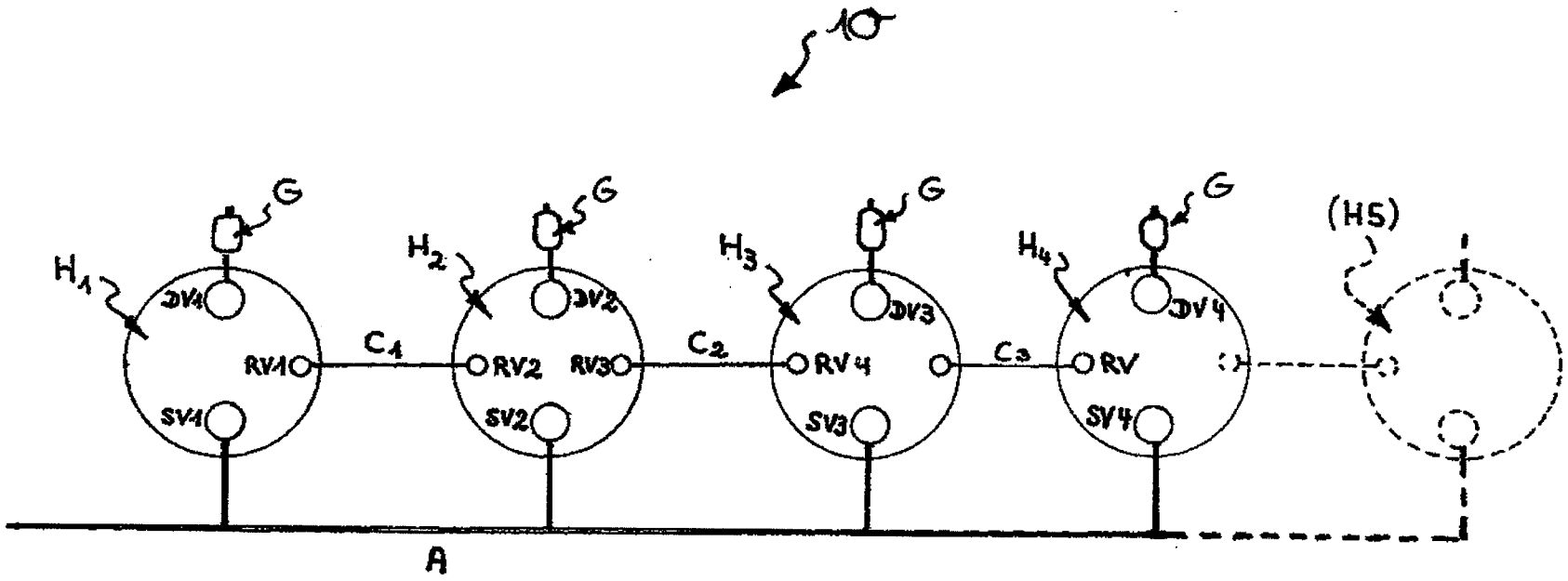
FIG. 2: a membrane suction pump, also shown in a schematic view, however here embodied with four stages.

From a comparison of FIGS. 1 through 2 it becomes apparent that the membrane suction pump may be embodied not only with two or three stages, but also may comprise more than three pump stages. FIG. 2 shows a four-stage membrane suction pump with four pump chambers $H_1$, $H_2$, $H_3$ and $H_4$. The pump chambers $H_1$, $H_2$, $H_3$ $H_4$ of the membrane suction pump 10 shown in FIG. 2 each have a fluid inlet, at least comprising an inlet valve SV1, SV2, SV3 and/or SV4 and a fluid outlet, at least comprising one outlet valve DV1, DV2, DV3 and/or DV4. While the fluid inlet of the pump chambers $H_1$, $H_2$, $H_3$, $H_4$ is connected via a suction line A, the fluid outlets of the pump heads $H_1$, $H_2$, $H_3$, $H_4$ are embodied open towards the atmosphere such that a pressure line B connecting the fluid outlets can be omitted. Here, it is beneficial for the fluid outlets of the pump heads $H_1$, $H_2$, $H_3$, $H_4$ to each be guided to a muffler G. The successive pump chambers $H_1$, $H_2$, $H_3$, $H_4$ are each connected to each other via a connection line C1, C2, C3 such that the membrane suction pump 10 in FIG. 2, upon reaching and particularly exceeding a pressure difference in the suction line, change from a parallel operation of its pump chambers $H_1$, $H_2$, $H_3$, $H_4$ to a serial operation of said pump chambers $H_1$, $H_2$, $H_3$, $H_4$. Here, the connection lines C1, C2, C3 connecting the pump chambers $H_1$, $H_2$, $H_3$, $H_4$ following each other are each interposed by one check valve RV1, RV2, RV3, RV4, RV5, RV6 at the inlet side as well as the outlet side.

FIG. 2 shows in dot-dash lines that the membrane suction pump 10 may also comprise more than four pump chambers $H_1$, $H_2$, $H_3$, $H_4$, $H_5$.

Figure 3:
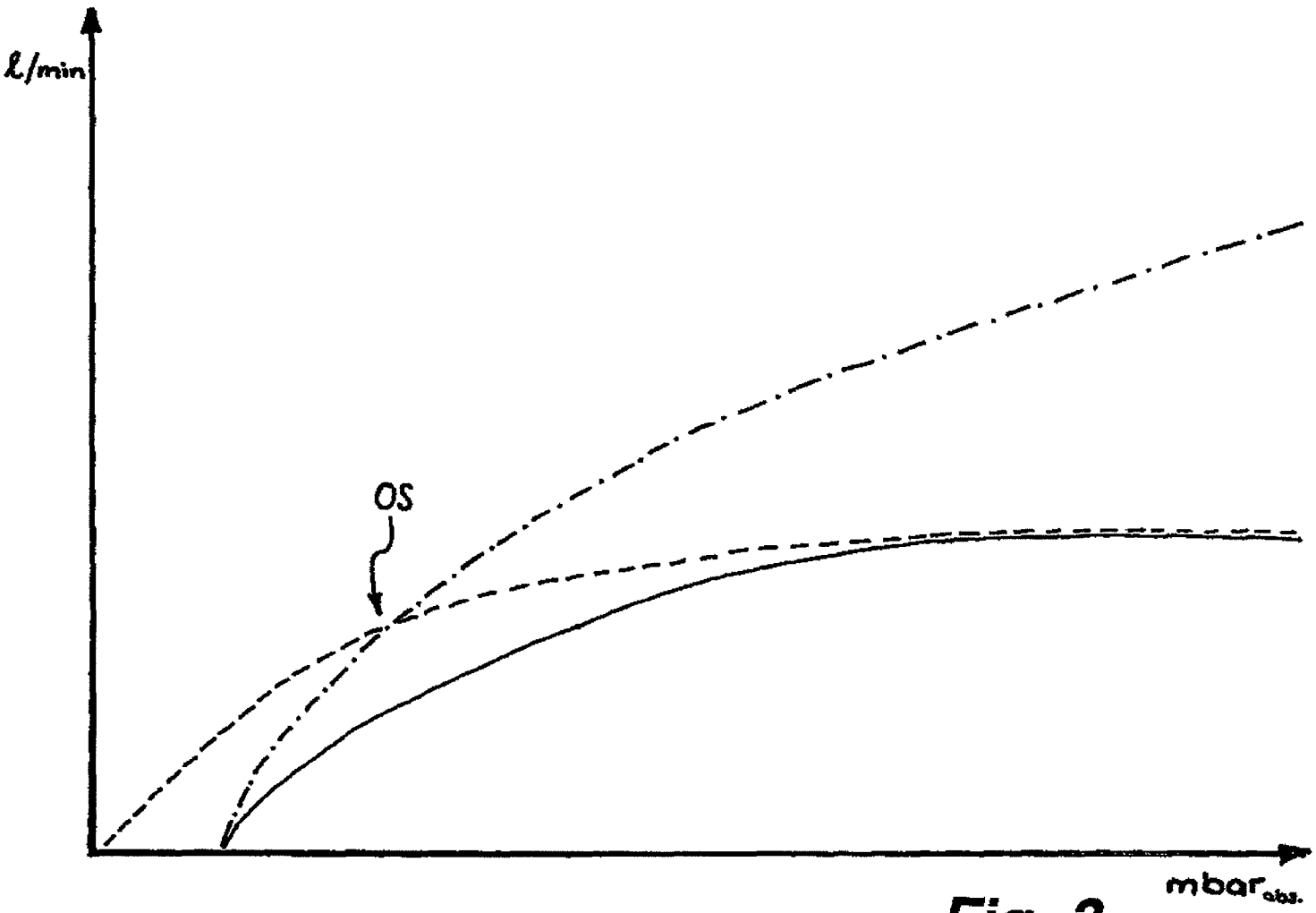
FIG. 3: a graph of the flow rate and/or the suction capacity of a multi-stage membrane suction pump shown in FIGS. 1 and 2 depending on the final vacuum achieved in reference to a one-stage membrane pump.

FIG. 3 shows the flow rate and/or the suction performance of the membrane suction pump 10 shown in FIGS. 1 and 2 in reference to the vacuum achieved. While the continuous line shows the suction capacity of a one-stage pump, limited by the final vacuum achieved, the dashed line indicates that parallel-switched pump chambers are no different with regard to the final vacuum achieved, but differ in the flow rate. When the pump chambers are switched serially in a multi-stage membrane suction pump, the suction capacity can be compared to a one-head membrane pump, however the pump chambers switched serially can achieve a considerably lower final vacuum (cf. dot-dash line in FIG. 3.)

The membrane pumps shown in FIGS. 1 and 2 now follow, in the starting phase of a pumping process, the curve progression of membrane heads switched parallel (dot-dash line) in order to then, at the optimal switchover point, merge to the curve progression of a membrane suction pump switched serially, which can be controlled by the design of the valve size and the weight of the check valves. Here, the membrane suction pumps 10 shown in FIGS. 1 and 2 are characterized such that they achieve a lowest-possible final vacuum in the shortest time possible.

Figure 4:
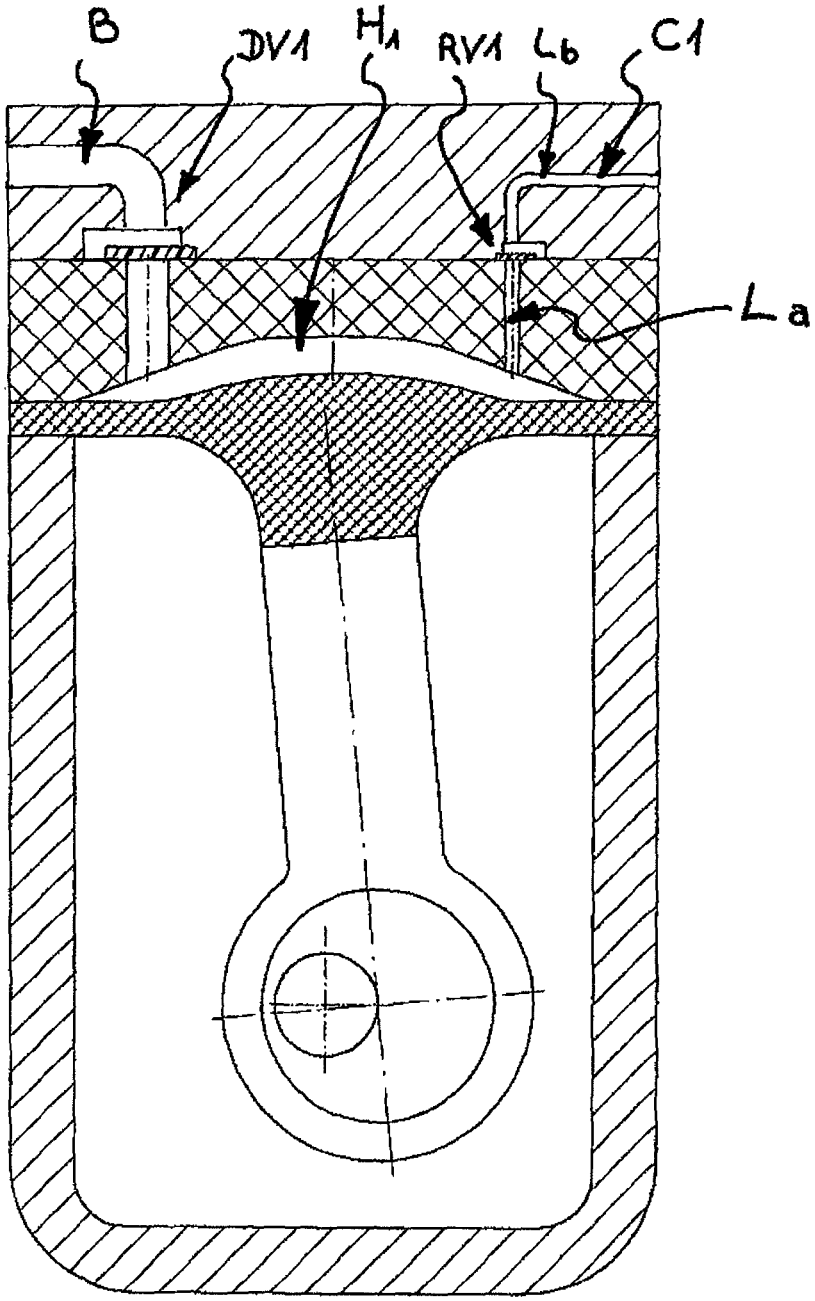
FIG. 4: the first pump stage of the multi-stage membrane suction pump shown in FIGS. 1 and 2 in a longitudinal cross-sectional view in the area of the check valve provided in the fluid outlet and a check valve arranged in a connection line.

FIG. 4 shows the first pump stage $H_1$ similar to a multi-stage membrane suction pump shown in FIG. 1 or 2. While the fluid inlet is arranged outside the cross-sectional plane, the outlet valve DV1 interposed in the fluid outlet and the check valve RV1 provided in the connection line C1 are clearly discernible. When comparing the valves DV1 and RV1 it becomes apparent that the check valve RV1 provided in the inlet area of the connection line C1 is embodied smaller in reference to the inlet and outlet valves of the pump chambers, and that a line section La of the connection line C1, having a smaller clear cross-section of the line compared to the inlet and outlet valves, is allocated to said check valve RV1, open towards the adjacent pump chamber $H_1$. Due to the fact that the connection line C1 is only effective in the range of the optimum switchover point and due to the fact that the connection line C1 can only handle comparatively low flow rates in this pumping phase the clear cross-section of this connection line C1 can be embodied relatively small in reference to the suction line and the pressure line. This also allows, among other things, to embody the check valve RV1, provided in the connection line C1, with a very small cross-section for the flow, compared to the suction and the pressure valves, and to be embodied with an appropriately small diameter. This way, the check valve RV1 can also react quickly, due to the low weight of its disk-shaped valve or retaining element, when closing the suction and pressure valves. Due to the fact that the line section $L_a$ has a considerably smaller clear cross-section of the line compared to the inlet and outlet valves, the dead space remaining between the check valve RV1 on the one side and the adjacent pump chamber $H_1$ can be kept so low that even the creation of a very low final vacuum is possible. While the line section $L_a$ leading to the adjacent pump chamber $H_1$ has a comparatively small clear cross-section of the line, the line section $L_b$ provided between the check valves RV1 and RV2 may show a greater cross-section of the line, if applicable.

The exemplary embodiment, shown in FIG. 4, shows the line sections $L_a$ and $L_b$ with similar clear cross-sections of the line.

The invention claimed is:

1. A multi-stage membrane suction pump comprising at least three pump chambers, each including a fluid inlet having at least one inlet valve and a fluid outlet having at least one outlet valve, as well as a suction line connecting the fluid inlets of the pump chambers, with successive ones of the pump chambers each being connected to each other via at least one connection line such that, upon at least one of reaching or exceeding a differential pressure in the suction line, an operation of the pump changes from a parallel operation of the pump chambers to at least also a serial operation of said pump chambers, at least one check valve, open to a downstream pump stage, is interposed in an inlet area and in an outlet area of the at least one connection line, and the check valves provided in the inlet area and in the outlet area of each connection line are embodied smaller in reference to the inlet valves and the outlet valves of the pump chambers, one line section of each of the connection lines, open towards the adjacent pump chamber, being allocated to said check valves, has a smaller clear cross-section in reference to the inlet valves and the outlet valves, and the at least one inlet valve, the at least one outlet valve, and two of the check valves open in each of the pump chambers located between the chamber of a first one of the pump stages and the chamber of a last one of the pump stages.

2. A membrane suction pump according to claim 1, wherein all of the check valves are sized or designed such that in a starting phase of a pumping process the inlet valves and the outlet valves are operational and the check valves are activated in a subsequent phase of the pumping process.

3. A membrane suction pump according to claim 1, wherein the one line section of each of the connection lines, connected to the adjacent pump chamber, that is allocated to the check valves, is sized in reference to an opening of the inlet valves and an opening of the outlet valves such that the line sections form a dead space smaller in reference thereto.

4. A membrane suction pump according to claim 1, wherein at least one of the suction line or the pressure line has a clear cross-section of the line that is greater in reference to the at least one connection line.

5. A membrane suction pump according to claim 1, wherein the outlet valves are embodied open towards the atmosphere, with an interposed muffler.

6. A membrane suction pump according to claim 1, wherein the check valves each comprise a valve disk as a valve body or a retaining element and a pressure range of a differential pressure triggering a change to serial operation can be at least one of predetermined or preset by at least one of a diameter a weight of the valve disks.

7. A membrane suction pump according to claim 1, wherein membranes allocated to successive ones of the pump stages are clocked off-set in reference to each other with regards to suction and expulsion movements.

8. A membrane suction pump according to claim 7, wherein the membranes allocated to successive ones of the pump stages are clocked off-set by 180° in reference to the suction and expulsion movements.

9. A membrane suction pump according to claim 1, wherein at least one of the inlet valves, one of the outlet valves, and one of the check valves open in a first and a last pump stage of the membrane suction pump.

* * * * *